US005623740A

United States Patent [19]

Burns et al.

[11] Patent Number: 5,623,740

[45] Date of Patent: Apr. 29, 1997

[54] PAINT ROLLER EDGE GUARD

[75] Inventors: Harlow H. Burns, 1052 S. 20th St., Omaha, Nebr. 68108; Van H. Burns; Brian D. Burns, both of Omaha, Nebr.

[73] Assignee: Harlow H. Burns, Omaha, Nebr.

[21] Appl. No.: 426,941

[22] Filed: Apr. 21, 1995

[51] Int. Cl.[6] ..... B05C 1/00

[52] U.S. Cl. ..... 15/230.11; 15/248.2; 118/252; 118/256; 118/258; 118/264; 118/504

[58] Field of Search ..... 118/252, 256, 118/258, 264, 504; 15/230.11, 248.2, 246

[56] References Cited

U.S. PATENT DOCUMENTS

| | | | |
|---|---|---|---|
| 2,763,022 | 9/1956 | Glacken | 15/248 |
| 3,052,910 | 9/1962 | Kushner | 15/531 |
| 3,369,269 | 2/1968 | Deck | 15/230.11 |
| 3,623,180 | 11/1971 | Anderson | 15/230.11 |
| 3,685,084 | 8/1972 | Bennett | 15/230.11 |
| 3,832,749 | 9/1974 | Hawk | 15/230.11 |
| 4,100,642 | 7/1978 | Gabor | 15/114 |
| 4,564,970 | 1/1986 | Latraverse | 15/248.2 |
| 5,444,891 | 8/1995 | Benson | 15/230.11 |

*Primary Examiner*—Laura Edwards
*Attorney, Agent, or Firm*—Law Offices of John A. Beehner

[57] ABSTRACT

A paint roller edge guard apparatus facilitating the painting of a wall surface adjacent a non-painted surface from the application of paint to the non-painted surface from the roller sock. The apparatus comprises a handle and an edge guard having four edges and front and back faces. The edge guard is pivotally and rotatable supported on the handle. The roller is rotatably supported on the handle such that the roller may be rotated between a painting position, wherein the roller sock longitudinal axis is perpendicular to and adjacent the edge guard front face, and a filling position wherein the roller sock longitudinal axis is parallel to the edge guard front face. The roller sock may be placed in contact with the painted wall by application of pressure to the handle deflecting the edge guard rearward allowing the roller sock to contact the painted wall surface. In an alternative embodiment, the roller and edge guard may be mounted on separate handle portions such that the edge guard and roller may be separated by separating the handle portions. A toothed roller may also be associated with the roller to facilitate its rotation on slick surfaces.

17 Claims, 6 Drawing Sheets

PAINT ROLLER EDGE GUARD

BACKGROUND OF THE INVENTION

1. Technical Field

The method and apparatus of the present invention relate generally to a painting method and apparatus. More specifically, they relate to a method and apparatus of preventing unwanted paint from adhering to an adjacent wall or trim piece during the painting of a surface. The apparatus employs a conventional roller "sock" having a nap for releasable retension of paint. The roller is placed into a container having a quantity of paint therein in the conventional manner such that the paint is temporarily absorbed into the sock nap. The roller sock is then placed against the surface to be painted and the rolled theron such that a quantity of apint is transferred thereto.

Currently, the most common method of preventing the application of paint on a surface adjacent the painted wall is to apply a quantity of tape thereto such that any paint inadvertently transfered thereon may be easily removed simply by removing the tape. Installation of the protective tape is clearly quite a time-consuming process. Additionally, the protection afforded by such a procedure is only as good as the precision with which the protective tape is applied to the surface to be protected. Consequently, it is highly desirable to provide an apparatus which to a great extent could automate the protective procedure, allowing walls to be painted up to a corner with much greater ease and speed.

The present invention adds a protective edge guard adjacent the end of the roller and perpendicular thereto. The edge guard is placed against the adjacent wall surface, thereby acting as a barrier to the application of any paint to this adjacent surface.

2. Description of the Prior Art

As mentioned above, one of the primary prior art methods for protecting a surface adjacent a painted wall is to cover the surface to be protected with a layer of tape. After the desired surface is painted, the protective tape would simply be removed, thereby removing any paint which inadvertently was transferred to this protective tape. In addition to this highly manpower-intensive method, several prior art devices have been developed to simplify this protective procedure. One such example is illustrated in the Deck patent, U.S. Pat. No. 3,369,269.

Deck discloses a paint roller apparatus having a cover plate which is adapted to occupy a plane perpendicular to the longitudinal axis of the roller which is supported by a "main handle". The cover plate is supported on a handle adapted to slide up and down the shaft of the main handle. The shaft of the main handle is constructed such that when the handle supporting the cover plate is slid downwardly, rotation of the cover plate support handle is urged. Thus, there is both a downward and rotational movement of the cover plate away from the paint roller. While the Deck apparatus clearly attempts to provide some degree of assistance in preventing the unwanted application of paint to an adjacent surface, there are several limitations to the apparatus. First, when the cover plate is in the working position, perpendicular to the longitudinal axis of the roller, there is no means for providing rotation of the edge guard. Thus, it appears that the roller handle would need to be maintained in constant angle relative to the painted wall surface in order to maintain proper contact between the wall and the edge guard. This limitation makes it difficult to accommodate bumps or other uneven distributions in the wall surface or corner as the roller is moved along the painted surface. Therefore, any encounter with a bump or other undulation in the surface is likely to leave a discontinuity in the painted surface, known in the art as "holidays". Additionally, movement of the paint shield relative to the roller, instead of moving the roller relative to the paint shield, increases the likelihood that the wall-contacting edge of the paint shield would encounter the tip of the roller when being moved into the working position. If such contact were made between the edge of the shield and the roller, paint would be transferred to the guard edge or bristles and possibly into the protected corner.

Another prior art example of a paint roller guard apparatus is illustrated in Glacken, U.S. Pat. No. 2,763,022. Glacken discloses a guide apparatus which is adapted to be releasably secured to the roller support shaft in a recess provided in one end of the roller. The design of the Glacken apparatus calls for the removal and reinstallation of the guide plate each time the roller sock is filled with paint. Additionally, the snap fit of the edge guard does not provide for any spring biasing movement of the guard during the painting operation.

Anderson, U.S. Pat. No. 3,623,180, provides an apparatus similar to the Glacken device wherein an edge guard is snap fit onto the roller support shaft. The edge guard is provided with an off-center mounting so that it may be rotated out of position when the roller is charged with paint.

None of the prior art devices offers a paint edge guard adapted for both pivotal and rotational movement in the working embodiment to accommodate surface irregularities and placement angles during use.

Therefore, it is a primary objective of the present invention to provide a paint roller guard apparatus having a guard which is both pivotally and rotatably mounted for maximum flexibility in adapting to undulations in the paint surface contour during the painting procedure.

It is a further objective of the present invention to provide a paint roller guard apparatus having a paint roller which is adapted to be pivotally mounted relative to the paint guard so as to minimize the possibility of placing paint on the protective edge of the guard shield.

It is a further objective of the present invention to provide a paint guard shield which is spring biased to a neutral position and which may be deflected out of the neutral position during painting but which will return to the neutral position upon release of pressure on the paint handle.

A still further objective of the present invention is to provide a paint roller guard apparatus having a guard shield which is generally rectangularly shaped wherein the longer axis may be placed in the general direction of movement of the paint roller so as to minimize the possibility of the guard rolling during the painting operation.

A further objective is to provide a paint roller guard apparatus wherein the movement of the roller away from the guard shield may be effected by either of two embodiments. In a first embodiment, by pivotal rotation of the roller itself. In an alternative embodiment by separating the handle wherein one handle portion comprises the means for supporting the guard shield with the remaining handle portion comprising the means for supporting the paint roller.

SUMMARY OF THE INVENTION

A paint roller edge guard apparatus facilitating the painting of a wall surface adjacent a non-painted surface by preventing the application of paint to the non-painted surface from the roller sock. The apparatus comprises a handle and an edge guard having four edges and front and back faces. The edge guard is pivotally and rotatably supported on the handle. The roller is rotatably supported on the handle such that the roller may be rotated between a painting position, wherein the roller sock longitudinal axis is perpendicular to and adjacent the edge guard front face, and a filling position wherein the roller sock longitudinal axis is parallel to the edge guard front face. The roller sock may be placed in contact with the painted wall by application of pressure to the handle deflecting the edge guard rearward allowing the roller sock to contact the painted wall surface.

In an alternative embodiment, the roller and edge guard may be mounted on separate handle portions such that the edge guard and roller may be separated by separating the handle portions.

A toothed roller may also be associated with the roller to facilitate its rotation on slick surfaces.

BRIEF DESCRIPTION OF THE DRAWINGS

FIG. 1 is a perspective view of a first embodiment of the present invention showing its use in painting a wall surface adjacent a trim piece.

FIG. 2 is a side view of the embodiment illustrated in FIG. 1 showing the paint roller in the two primary positions, namely the working position (solid lines) and the paint charging position (phantom lines).

FIG. 3 is another side view oriented 90° to that shown in FIG. 2 further illustrating the movement of the roller between the two primary positions.

FIG. 4 is top view of the apparatus with the roller in the working position having the guard shield positioned perpendicular to the longitudinal axis of the roller adjacent thereto.

FIG. 5 is an end view of the apparatus showing in detail the freedom of movement associated with the guard shield and in particular, its ability to rotate about its axis of attachment to its support shaft and the pivotal side-to-side movement of the support shaft from a neutral biased position.

FIG. 6 is a sectional view taken along the lines indicated in FIG. 2 showing the spring biasing means used to bias the guard shield support shaft in the neutral position.

FIG. 7 is another sectional view taken along the lines indicated in FIG. 2 showing the means for pivoting the roller between the working and paint filling positions.

FIG. 8 is a perspective view showing a second embodiment of the present invention in a working configuration painting a wall surface adjacent a trim piece.

FIG. 9 is a side view of the second embodiment providing a view similar to that shown in FIG. 2 and in particular the positioning of the paint roller adjacent the guard shield in the working position.

FIG. 10 is another side view rotated 90° from that illustrated in FIG. 9 again showing the relative orientation of the edge guard shield and roller when in the working position.

FIG. 11 is a top view of the second embodiment of the apparatus again showing the roller in the working position and the guard shield positioned perpendicular to the longitudinal axis of the roller.

FIG. 12 is an end view similar to that illustrated in FIG. 5 again showing the rotational and pivotal mounting of the edge guard shield.

FIG. 13 is an illustration showing the spring biasing means used to bias the edge guard shield support shaft in the neutral position.

FIG. 14 is a perspective view illustrating the split handle of the second embodiment of the apparatus wherein the eg and roller are separated by separating the respective handle portions supporting either the roller or edge guard shield.

DESCRIPTION OF THE PREFERRED EMBODIMENT

As mentioned, FIGS. 1–7 illustrate a first embodiment of the present invention and FIGS. 8–14 represent a second embodiment.

Figure 1:
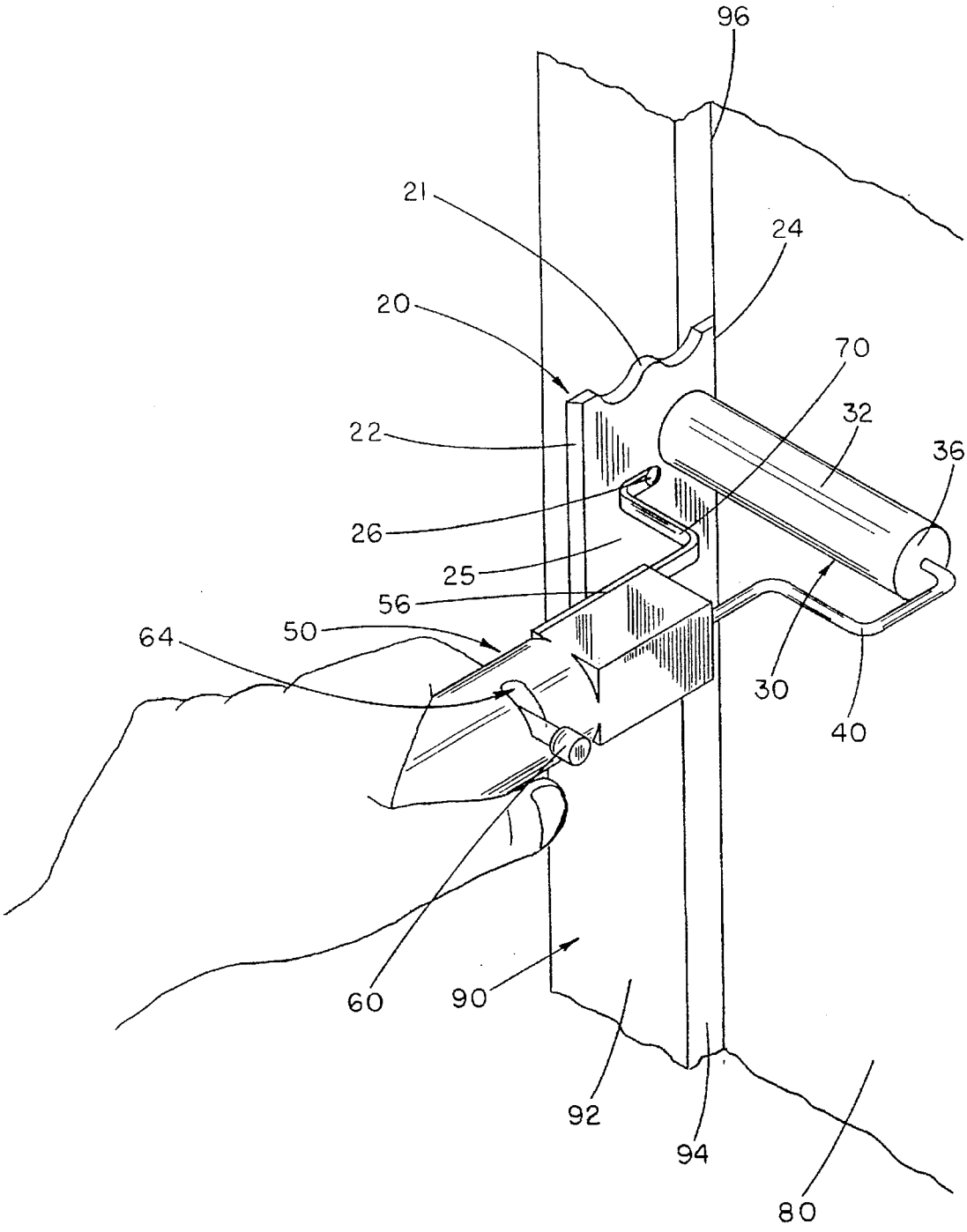
FIG. 1 through 7 illustrate a first embodiment of the invention.

A working illustration of the first embodiment of the present invention is shown in FIG. 1. As seen in the figure, a handle 50 is used to support both the roller 30 and the edge guard shield 20 by means of support shafts 40 and 70 connected respectively thereto. In the first embodiment illustrated in FIGS. 1–7, the pivotal movement of roller 30 in relation to edge guard shield 20 is made by lever 60. Lever 60 is connected to roller support shaft 40 such that movement of lever 60 is operative to effect a similar movement in shaft 40 and consequently roller 30. This movement is illustrated more clearly in figures below. Edge guard 20 is rotatably secured to shaft 70 by means of connector 26. This connector 26 allows 360° rotation of shield 20 about this axis.

As shown in the figure, edge guard 20 comprises a substantially flat, generally rectangular shaped member having four sides 21–24 and front and back faces 25 and 27. As seen in the figure, generally rectangular edge guard 20 is connected to support arm 70 by means of a connector 26. Connector 26 allows the edge guard 20 to be rotatably mounted to support arm 70 such that a complete 360° rotation of edge guard 20 is possible. The rotatability of edge guard 20 allows the angle between the handle and the wall 80 to be varied while still maintaining good contact between the edge guard 20 and the corner. In the present invention, connector 26 may be any type of a snap fit or other connector allowing edge guard 20 to be rotatably secured to support arm 70.

As also shown in the figure, the roller brush 32, commonly referred to in the art as the "sock", is supported along its longitudinal axis by means of support arm 40 directed along the center axis thereof. As will be shown and described in figures below, support arm 40 is adapted to support and rotate roller sock 32 between a position perpendicular to face 25 of edge guard 20 and a position parallel thereto.

In a first preferred embodiment of the invention, illustrated in FIG. 1, lever 60 is integrally formed with and thus provides a direct connection with roller sock support arm 40. Thus, lever 60 provides a means for rotating support arm 40, and consequently roller sock 30, between a working position generally perpendicular to edge guard 20 and a paint charging or filling position parallel to edge guard 20.

As seen in the figure, handle 50 is adapted to receive edge guard support arm 70 and roller support arm 40 therein, thereby facilitating the placement of roller 30 on wall 80 and the application of paint thereto. As seen in the figure, handle 50 would be gripped by the painter and used to place the roller sock 30 in contact with wall surface 80 for painting. The painter would position the apparatus such that the rear face 27 was in contact with side face 94 of trim piece 90 and such that the forward edge 24 of edge guard 20 contacts the corner defined by the intersection of the painted wall surface 80 and the side face 94. Similar placement occurs if the adjacent non-painted surface is a wall instead of a trim piece. Since the edge guard support arm 70 is spring biased, the painter is able to apply the amount of force necessary on roller sock 30 to contact painted wall surface 80 such that the proper amount of paint is distributed onto wall surface 80. Additionally, due to the pivotal nature of the connection between edge guard 20 and edge guard support arm 70, the operator is able to adjust the orientation (angle) of the handle 50 with respect to the painted wall surface 80. Such an adjustment greatly facilitates use of the apparatus in the extreme vertical positions (i.e., at the top and bottom of the wall). Movement of various components of the apparatus and their relative positioning are shown more clearly on some of the following figures.

Figure 2:
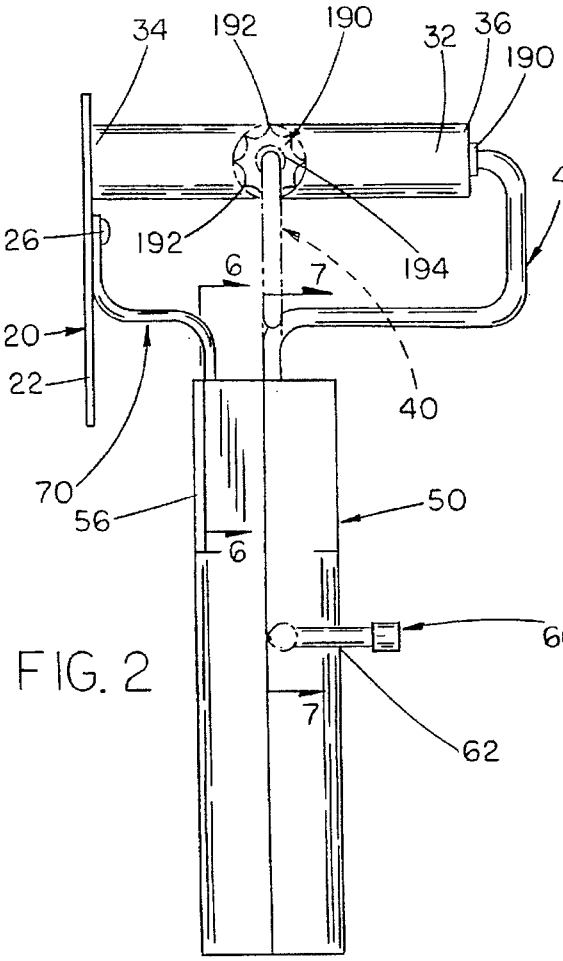
Figure 7:
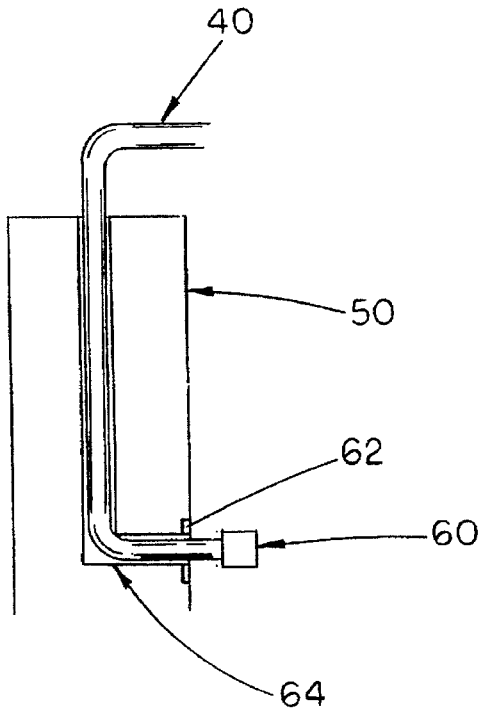

FIG. 2 is a side view of the apparatus showing with particular clarity the movement of the roller sock from the working position illustrated with solid lines and a paint charging position indicated in phantom lines. As seen in FIG. 1 and the solid lines of FIG. 2, the working position of roller sock 30 is defined by the positioning of the roller sock 30 with the longitudinal axis thereof perpendicular to edge guard 20 and further with the edge guard 20 in adjacent relation to end 34 of roller 30. As seen in FIG. 1 and described in connection therewith, this working position is utilized when applying paint from roller 30 onto wall surface 80. Alternatively, roller 30 may be moved from the working position into a paint charging position wherein the roller sock 32 may be charged with a quantity of paint for application to a wall surface. This paint charging position would be defined by an approximately 90° rotation of roller 30 from the working position. This paint charging position for roller 30 is illustrated using phantom lines in FIG. 2. As seen in this figure, in the paint charging position, roller 30 and support shaft 40 have been pivoted approximately 90° relative to the working position illustrated by solid lines in FIG. 2. As seen in the figure, the axis of rotation is approximately the center line of handle 50. As mentioned above in connection with FIG. 1, in the first embodiment, the means for accomplishing this 90° rotation of the roller 30 is lever 60. As seen more clearly below in connection with FIG. 7, in this preferred embodiment, lever 60 is an integral part of the roller support shaft 40 which projects outwardly of handle 50 through aperture 64 (FIG. 7). Therefore, pivoting of lever 60 is operative to pivot roller support shaft 40 and consequently roller 30.

Figure 3:
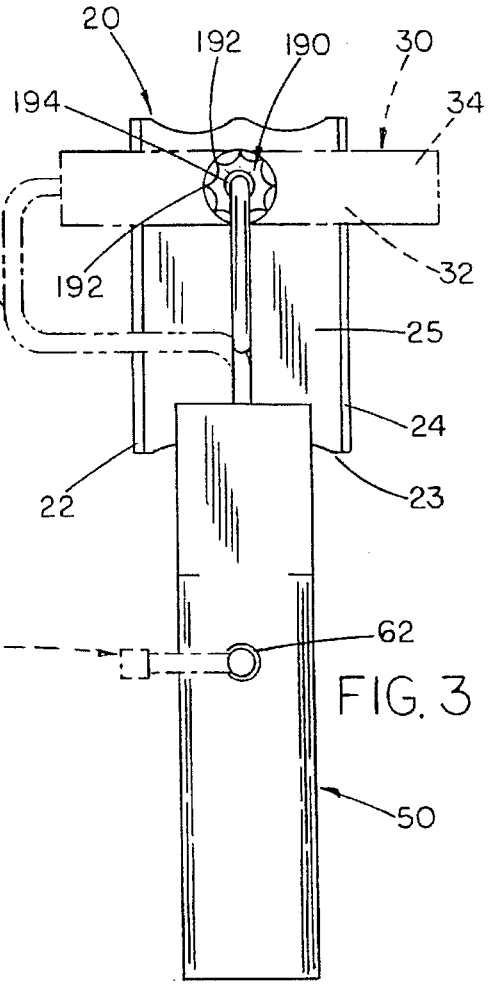

As illustrated in a first embodiment, this rotation of roller 30 may be accomplished simply by flipping the lever 60 from the position indicated in FIG. 1 and in solid lines in FIG. 2, with the thumb into the position indicated in phantom lines in FIGS. 2 and 3. As shown in FIGS. 2 and 3, a locking means 62 may also be provided for locking lever 60 in either of the two positions, namely the working position illustrated in solid lines in FIG. 2, or the paint charging position indicated in phantom lines in FIG. 2 and 3. In the preferred embodiment, this locking means 62 may be a simple piece of plastic or similar material adapted to establish a friction-tight fit between the lever 60 and the handle aperture 64 through which the lever 60 projects.

FIG. 3 is another side view rotated 90° from the orientation shown in FIG. 2. Again, the roller 30 is shown in solid lines in the working position, and by phantom lines in the paint charging position. As seen in the figure, the working position is characterized by the perpendicular orientation of the edge guard shield 20 and the longitudinal axis of the roller 30. Conversely, the paint charging position of roller 30 is characterized by a parallel relationship between the longitudinal axis of the roller 30 and the front face 25 of the edge guard 20. As seen by the phantom lines of FIG. 3, the lever 60 would be pivoted 90° from the orientation indicated in solid lines, in order to achieve the paint charging position of roller 30 indicated by phantom lines in the two figures.

Figure 4:
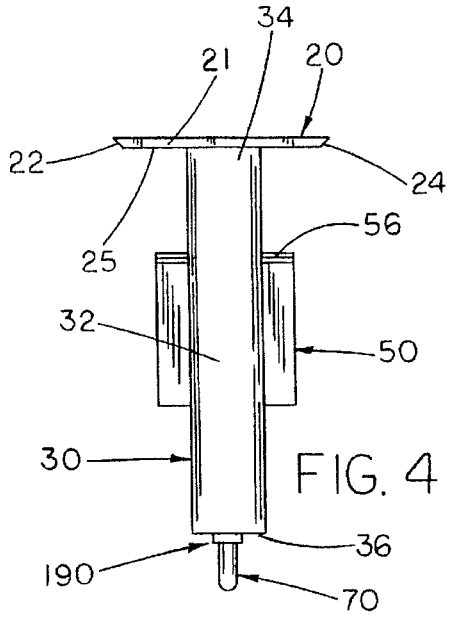

FIG. 4 is a top view of the apparatus with the roller 30 in the working position characterized by the perpendicular relationship between the edge guard 20 and the longitudinal axis of roller 30.

FIG. 4 illustrates with particular clarity an important feature of the present invention, namely the taper of sides 22 and 24 of edge guard 20. The taper of side edges 22 and 24 of edge guard 20 is helpful in ensuring that the edge guard 20 makes a paint-tight fit between the painted wall surface 80 and an adjacent wall or trim piece. Additionally, this taper minimizes the chance of getting paint on the sides of edge guard 20 when the roller is rotated into the working position. Thus, the taper design of sides 22 and 24 of edge guard 20 facilitates the objectives of the invention, restricting application of paint to the desired surface. In the preferred embodiment, the taper of sides 22 and 24 is approximately 45° from a thickness of approximately 1/32".

Figure 6:
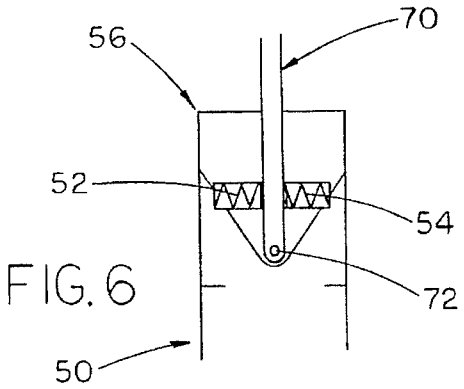
Figure 5:
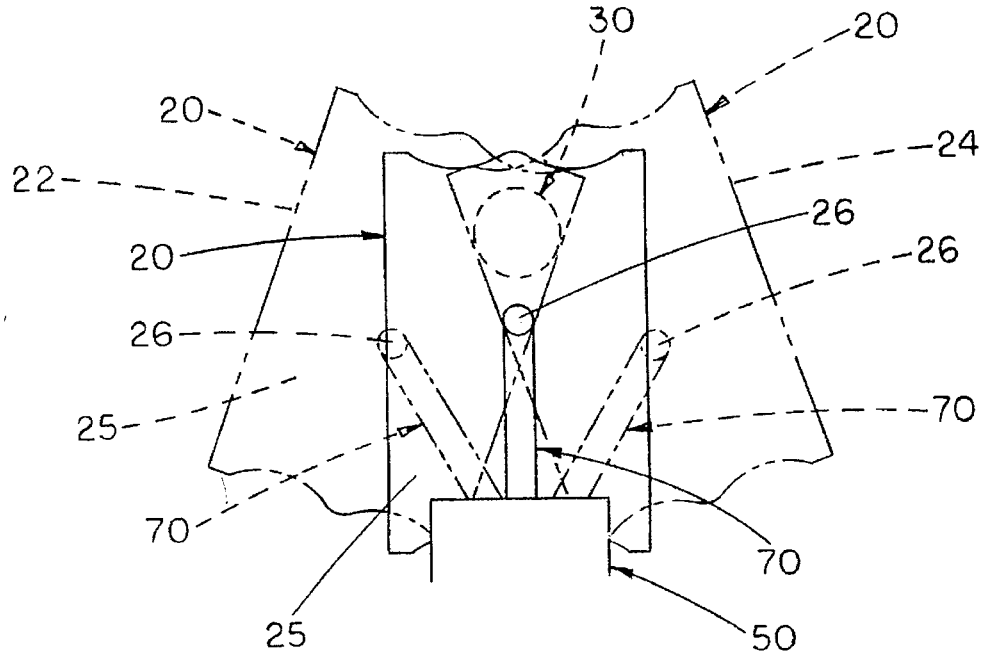

FIG. 5 is a side view of the apparatus taken looking face-on with front face 25 of edge guard 20. FIG. 5 illustrates the two degrees of movement of the edge guard 20. As mentioned above, edge guard 20 is rotatably connected with support arm 70 by means of connector 26. In the present invention, connector 26 could be any of a number of types of connectors such as a rivet or snap fit. The precise type of the connector used is not important so long as the connector allows rotation of the edge guard 20. Additionally, side-to-side motion of the edge guard 20 is provided by support arm 70. As shown in FIG. 6 below, support arm 70 is pivotally mounted within handle 50 such that it may be moved side to side as shown in FIG. 5. Support arm 70 is biased into the neutral position indicated in FIG. 5 by solid lines, using springs (FIG.6).

The side-to-side and rotational movement of edge guard 20 allowed by the pivotal mounting of support arm 70 allows the paint brush roller apparatus to accommodate a variety of wall surfaces. For example, if the wall surface 80 being painted contains any bumps or undulations, the rotation and pivoting of edge guard 20 will allow side wall 22 or 24 and paint roller sock 32 to maintain contact with corner 96 and wall surface 80, respectively. As is well understood in the art, one problem with prior art edge guards, especially those having a substantially rigid connection between the edge guard and the handle, is that when any irregularity or undulation in the wall surface is encountered, the roller has a tendency to skip, creating an unpainted spot on the wall corresponding with the irregularity. In the art, such unpainted areas are referred to as "holidays".

As mentioned, the side-to-side movement of support arm 70 is provided by the pivotal mounting of support arm 70 within handle 50. This pivotal mounting and associated spring biasing means are illustrated in the sectional view of FIG. 6. As seen in this figure, support arm 70 is secured to handle 50 by means of pivotal attachment 72. As shown in the figure, a "V" shaped mounting is used to allow for the side-to-side motion of the support arm 70 as indicated above in FIG. 5. In the preferred embodiment, a cover plate 56 may be used to provide access to the support arm mounting for maintenance, etc. The support arm 70 is biased into the neutral vertical position as seen in FIG. 6, and the solid lines of FIG. 5, by means of springs 74 and 76 positioned on opposite sides of support arm 70 and the walls of handle 50.

These springs 74 and 76 operate to impart a biasing resilience to maintain the support arm 70 in the neutral position. In the present invention, the biasing springs 74 and 76 are constructed of a spring material having a spring constant in the range of 35 to 60. In one preferred embodiment, springs having a spring constant of approximately 54 were found to have satisfactory results. Conversely, springs having a spring constant of less than approximately 35 were found to be too flexible, failing to maintain sufficient pressure on the support member 70 to keep it in good contact with the wall during the painting process. In such cases, edge guard 20 may have a tendency to bounce along the wall when it encountered irregularities. Clearly, many different types of springs would be satisfactory for providing the biasing force necessary. For example, springs having a carbon steel or stainless steel construction were found to be satisfactory.

FIG. 7 is a sectional view taken along the lines indicated in FIG. 2 showing with particular clarity the integral connection of lever 60 with roller support member 40 and the positioning of locking means 62. As seen in the view of FIG. 7, in the preferred embodiment, the lever 60 is an integral part of the roller support arm 40. As mentioned above, this allows the roller support arm 40 and roller 30 to be pivoted directly in response with the turning of lever 60, as described and shown above in connection with FIGS. 2 and 3. As also mentioned above, a locking means 62 is provided to releasably retain lever 60 in the desired position. Usually, this will be in either of the two extreme positions illustrated in FIGS. 2 and 3, namely the working position or paint charging position. However, there may be some circumstances where an intermediate position is desired. Regardless, locking means 62 provides a mechanism whereby the lever 60 will be releasably retained in whatever position it is placed. As mentioned above, in the preferred mode, locking means 62 could be a plastic insert which substantially fills any gap between lever 60 and aperture 64 through which support arm 40 and lever 60 are projected. Thus, locking means 62 would provide a friction-tight engagement between the handle aperture 64 and the lever 60.

As mentioned above, the present invention comprises two distinct embodiments. The distinction between the two embodiments is characterized by the manner in which the paint roller sock is moved between a working position and a paint charging position. The first of the two embodiments of the present invention is illustrated above in FIGS. 1–7. In this first embodiment, the means for moving the roller sock between the working and paint charging positions, as described in detail above, is the lever 60 which pivots the roller from a position with the longitudinal axis of the roller sock perpendicular to the edge guard 20, to a position where the longitudinal axes of the roller sock is parallel to the front face of the edge guard 20. Alternatively, in a second embodiment of the present invention, a handle having two portions with one portion supporting the edge guard and the other portion supporting the roller, allows the roller sock and edge guard 20 to be separated. This second, alternative embodiment is illustrated and discussed below in conjunction with FIGS. 8–14.

Figure 8:
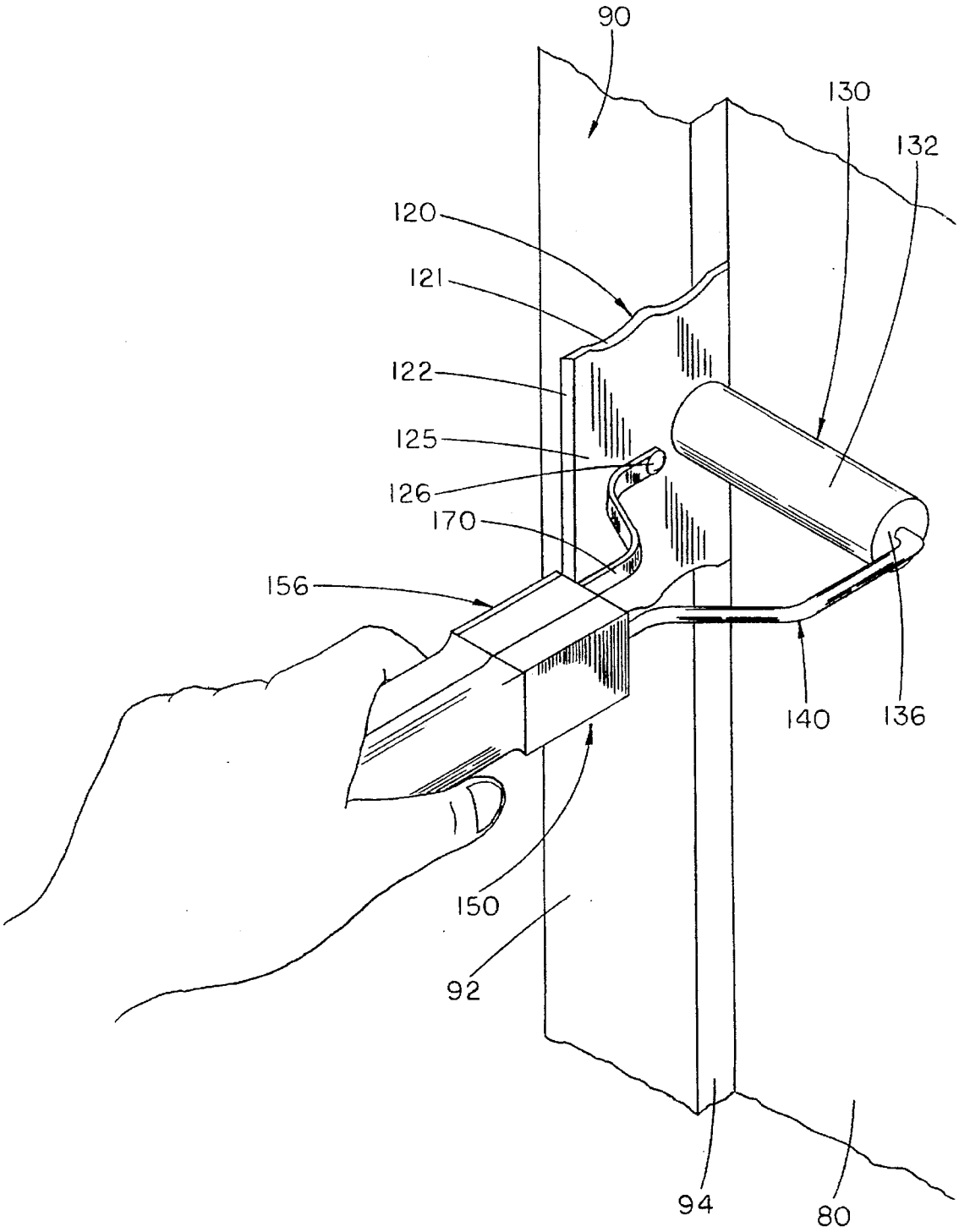
FIGS. 8–14 illustrate the second major embodiment of the present invention.

As seen in FIG. 8, the alternative embodiment roller apparatus comprises a handle 150 supporting the edge guard 120 and roller 130 on support shafts 170 and 140, respectively. As mentioned above, the main distinction between the first embodiment illustrated in FIGS. 1–7 and the alternative embodiment illustrated in FIGS. 8–14 is the design of the handle 150. In the alternative embodiment illustrated in FIGS. 8–14, handle 150 is divided into two sections **150*a* and 150*b*. As seen in the figure, and illustrated more clearly below, a first handle section 150*a* is adapted to support edge guard mounting shaft 170. A second handle portion 150*b* is adapted to support roller support shaft 140. As mentioned above, the main distinction between the embodiments illustrated in FIGS. 1–7 and FIGS. 8–14 is the manner in which the roller is moved between a working position and a paint charging position. In the embodiment illustrated in FIGS. 8–14, this means for moving the roller between the working position and the paint charging position is provided by the split handle. As will be described in more detail below, the roller 130 may be moved from the working position illustrated in FIG. 8 to a paint charging position, wherein the edge guard 120 and roller 130 are physically separated simply by separating the two handle portions 150*a* and 150*b*, thereby physically separating the roller 130 and edge guard 120**.

The working operation of the roller apparatus embodiment illustrated in FIG. 8 is nearly identical to that described above with the first embodiment, namely the operator would place the edge guard 120 adjacent the side face 94 of a trim piece 90 adjacent a wall surface 80 to be painted as illustrated in FIG. 8. The operator would maintain pressure on the edge guard 120 and roller against the trim piece 90 and painted wall surface 80, respectively. As mentioned above in connection with the first embodiment, the edge guard 120 is rotatably mounted to support shaft 170 by means of connector 16 which allows 360° rotation of edge guard 120 relative to connector 26. Additionally, edge guard 20 support shaft 170 is mounted within handle portion **150*a* such that side-to-side pivotal motion is permitted as described in more detail below. Thus, the operator is able to adjust the amount of pressure on the handle so as to keep the roller 130 in contact with the painted wall 80**.

Figure 9:
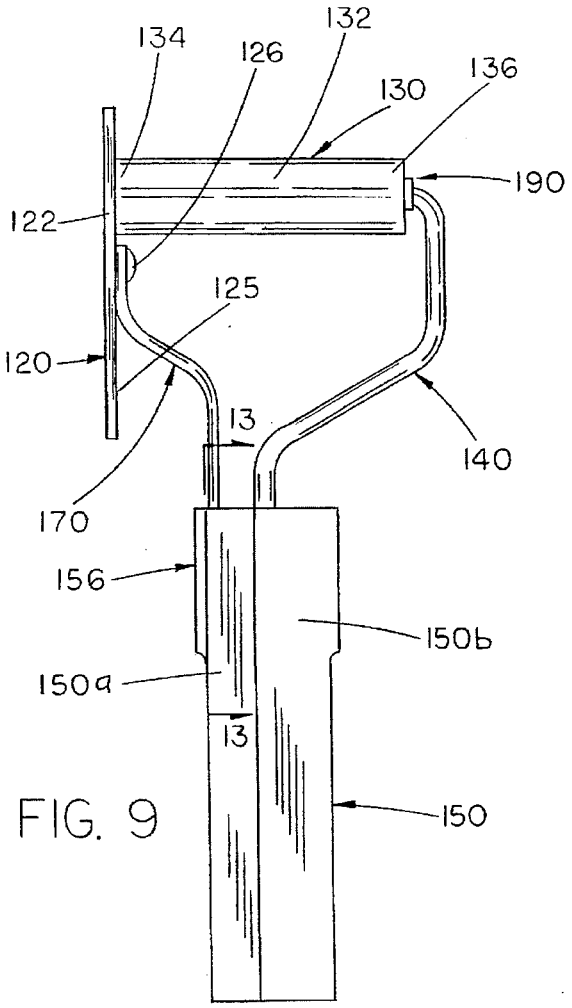

FIG. 9 is a side view showing the positioning of the handle portions **150*a* and 150*b* and consequently edge guard 120 and roller 130 in the working positions. As seen clearly in this figure, the working position is defined by the perpendicular orientation of the edge guard 20 front face 125 with the longitudinal axis of roller 130. As seen in this figure, the end of roller 130 would be placed in adjacent relation to the front face 125 of edge guard 120**.

Figure 10:
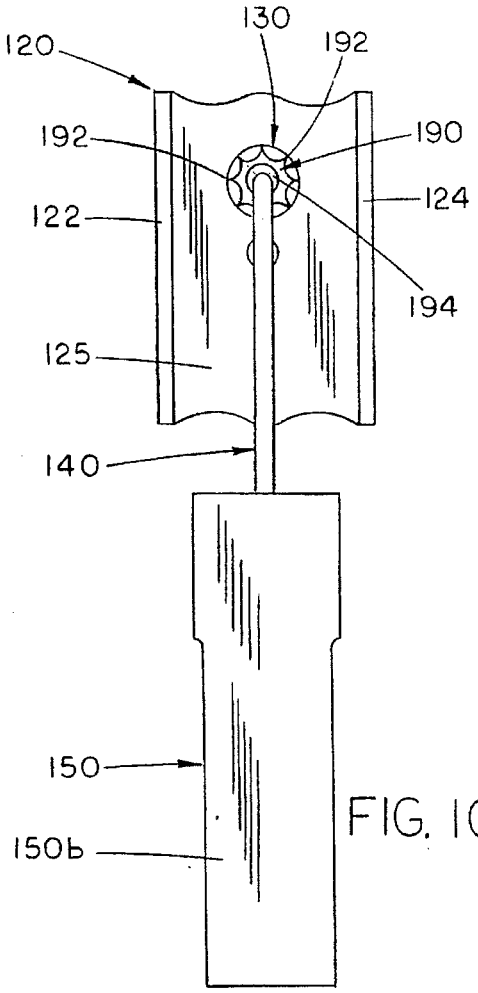

FIG. 10 is another side view rotated 90° from that illustrated in FIG. 9. As seen in this figure, with the roller 130 and edge guard 120 in the working position, is the generally rectangular shape of edge guard 120. As mentioned above in connection with the first embodiment, the generally rectangular shape of edge guard 120 resists any tendency of the edge guard 120 to rotate during application of paint to a wall surface.

Figure 11:
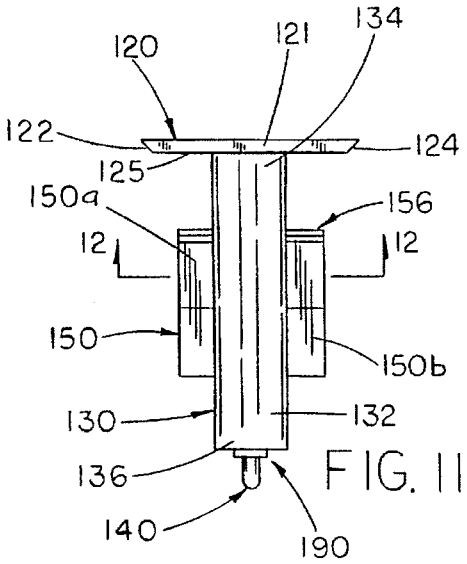

FIG. 11 is a top view of the alternative embodiment of the roller apparatus with the roller 130 and edge guard 120 in the working positions. As described above and as is shown in this figure, the working position is defined by the generally perpendicular relation between the longitudinal axis of roller 130 and the front face 125 of edge guard 120. As also shown in this figure, the end of roller 120 is placed in adjacent relation to the front face 125 of edge guard 120. As also shown in this figure and as is identical with the earlier described embodiment, the edge guard 120 comprises side edges 122 and 124, having a taper thereto. As described above in connection with the first embodiment, this taper in sides 122 and 124 of edge guard 120 permits the edge guard 120 to more exactly fit the junction between the painted wall surface 80 and the side member 94 of a trim piece 90 or adjacent wall surface. Thus, this taper in side walls 122 and 124 allows the roller apparatus to more effectively limit inadvertent application of paint to this adjacent surface.

Figure 13:
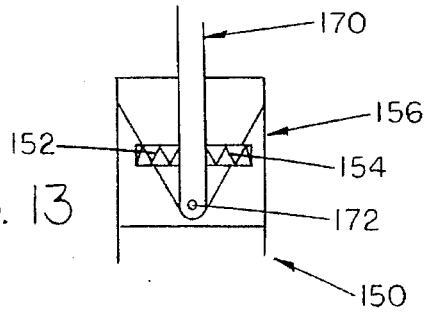
Figure 12:
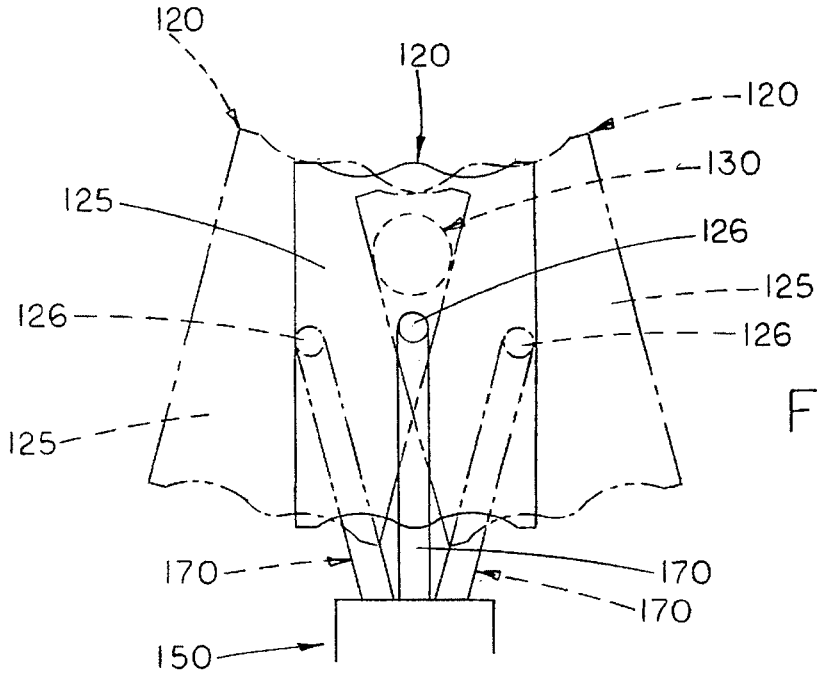

FIG. 12 is a side view illustrating the various movements of the edge guard 120 which are accommodated by the pivotal mounting of edge guard 120 to support shaft 170 and the pivotal mounting of shaft 170 within handle portion 150*a*. As mentioned above in connection with FIG. 5, the edge guard 120 is adapted for 360° rotational movement about connector 126 used to connect edge guard 120 to support shaft 170. Further movement is provided by the pivotal mounting of support shaft 170 within handle member 150*a*. As described below in connection with FIG. 13 and as has already been described above in connection with FIG. 6, this pivotal mounting of support shaft 170 within handle portion 150 *a* allows edge guard support 170 to pivot side to side as illustrated in the figure. As mentioned above in connection with FIG. 5, this ensures that the edge guard 120 is able to accommodate any undulations in the surface of the corner in which the application of paint is to be prevented. As described above in connection with FIG. 6, the edge guard support arm 170 is pivotally connected using connector 172. The edge guard support arm 170 is biased to a neutral position by means of springs 152 and 154 which are connected on opposite sides of support shaft 170 to the handle 150*a*. As shown in FIG. 13, a generally V-shaped portion is notched out of the top of handle 150*a* to accommodate this side-to-side pivoting movement of support arm 170. In addition to biasing support arm 170 in a neutral position as shown, springs 152 and 154 serve to provide a shock absorber type effect on the support arm 170 operating to maintain contact with the corner 96 during painting by constantly applying pressure against the surface. A cover plate 156 may be utilized to provide access to the support arm mounting for maintenance and the like.

Figure 14:
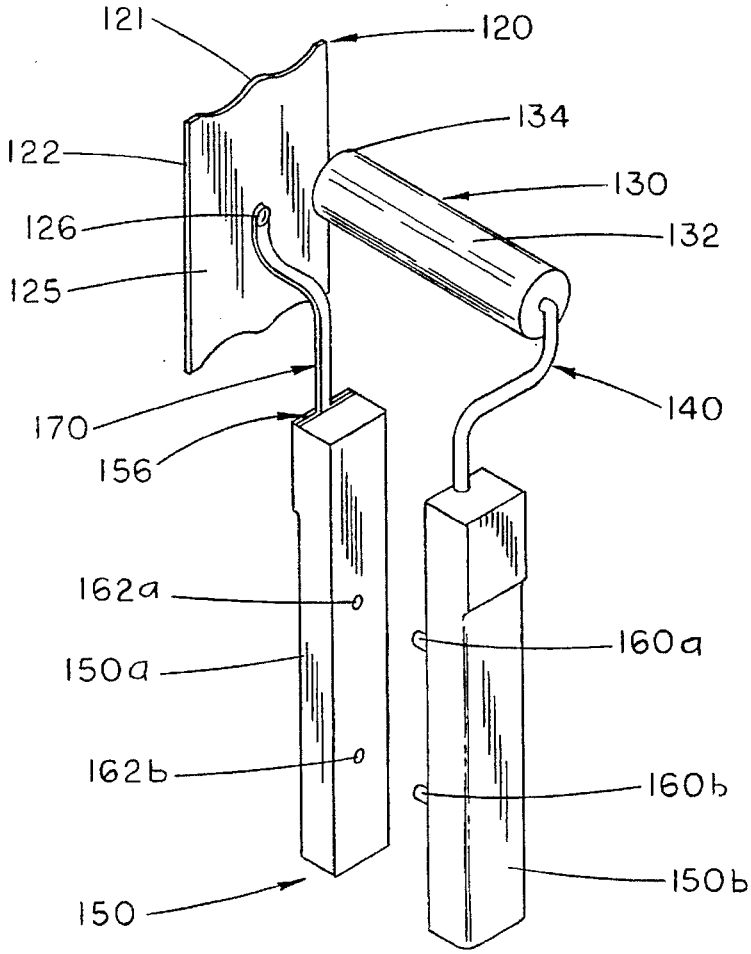

As mentioned above, the major distinction between the first and second embodiments of the present invention is the means by which the roller is moved between the working position adjacent the edge guard to a paint charging position wherein the roller is separated from the edge guard. FIG. 14 illustrates this distinction for the second embodiment. As mentioned above, the means by which the roller 130 and edge guard 120 are separated in this second embodiment is a split handle 150 comprising portions 150*a* and 150*b* which may be physically separated. This physical separation is illustrated in FIG. 14. As seen in this figure, the edge guard 120 and roller 130 may be separated simply by separating the two handle portions 150*a* and 150*b* as illustrated. As discussed above, it may be desirable to separate the edge guard 120 and roller 130 when paint is to be applied to the roller 130 or for cleaning thereof or the like. As seen in this figure, it may be desirable to provide a mechanism whereby the joining of the two handle portions 150*a* and 150*b* is facilitated by some type of guide pins or the like. In the present invention, this means for facilitating the engagement of the two handle portions 150*a* and 150*b* is by means of guide pins 160*a* and 160*b* which are adapted to be received in openings 162*a* and 162*b*, respectively. As shown in the figure, the guide pins 160*a* and 160*b* are positioned on handle portion 150*b* and the receiving apertures 162*a* and 162*b* are positioned on handle portion 150*a*.

Obviously, the positioning of these apertures and positioning pins may be changed from one handle portion to another. Additionally, the manner in which the handle portions are separated may be altered to conform with the situation presented. For example, in some cases it might be desirable to completely separate the two handle portions 150*a* and 150*b* as indicated in the figure. In other situations, it may be desirable simply to pivot the handle segments in opposite directions about the lower guide pin 160*b*. This may be accomplished by disengaging one of the positioning pins, for example 160*a*, from its receiving aperture 162*a* while leaving the lower positioning pin 160*b* partially received within its aperture 162*b* and then pivoting the top portions 150*a* and 150*b* in opposite directions. This would create a physical separation between the roller 130 and edge guard 120 thereby allowing the roller 130 to be charged with paint without suffering the application of paint to edge guard 120.

Owing to the amount of movement which may be accommodated by the handle portions, it is possible, in fact perhaps even desirable, to realign the roller 130 and edge guard 120 by first pivoting the edge guard 120 and roller 130 into alignment and then using a motion perpendicular to the face of edge guard 120, bring the end of roller sock 130 into contact with the front face 125 of edge guard 120.

In the preferred embodiment, edge guard side edges 22 and 24 and 122 and 124 are tapered approximately 45° from a thickness of approximately 1/32" in width of edge guard 120. This approximates the width of conventional paint masking tape. Thus, the edge guard 20 and 120 are able to accomplish the same paint masking results as conventional tape without the extremely time-consuming step of applying the masking tape to the surface to be protected.

The edge guard shield 20 or 120 may be constructed of plexiglass, plastic, or any other similar, semi-rigid material. It will be noted from the figures, especially FIGS. 12 and 5, that the top and bottom edges 21 and 23 and 121 and 123 are scalloped and that the corner at which the top and bottom sides join with the two sides 22 and 24 or 122 and 124 are slightly rounded. This rounding of the corners allows the edge guard 20 or 120 to accommodate abrupt bumps in the corner surface.

In the preferred embodiment, the connector 26 and 126 would preferably be a snap-on button connector to connect the edge guard 20 or 120 to the support shaft 70 or 170, respectively. This would allow the easy removal of edge guard 20 or 120 for cleaning, replacement or the like. Alternatively, a metal rivet may also be used for a more permanent connection. In either case, it is desirable to use a connection means which allows rotation of the edge guard 20 or 120 as described above.

In some case, it may also be desirable to use an additional engagement means frictionally engaged with roller 30 or 130 which may also engage the painted wall surface 80, thereby facilitating the rotation of roller 30 or 130 and the application of paint to the wall surface. In one embodiment, this additional engagement means for facilitating the rolling of roller 30 or 130 is a toothed roller 190 having a plurality of teeth 192 positioned radially around the shaft 194 thereof. The toothed roller may be employed as shown in FIGS. 2–4 and 9–11. The shaft 194 of toothed roller 190 is of an inside diameter greater than the diameter of roller support shaft 40 or 140 and having an outside diameter substantially equivalent to the inside diameter of the aperture of roller 30 or 130 adapted to receive support shaft 40 or 140, respectively. Thus, the toothed roller 190 is able to freely rotate on roller support shaft 40 or 140. Conversely, the substantial equivalence between the inside diameter of the roller aperture in side 36 and 136 and the outside diameter of the toothed roller shaft 194 ensures a friction tight fit between the toothed roller 190 and roller 30 and 130. Consequently, rotation of the toothed roller 190 is operative to rotate roller 30 or 130 about its longitudinal axis and about support shaft 40 or 140.

In the preferred embodiment, the diameter of the teeth 192 on toothed roller 190 is nearly the same diameter as the roller sock with which it is frictionally engaged. Thus, when pressure is applied to the roller sock against the wall surface 80 being painted, the teeth 192 will engage the wall surface while still allowing the nap of the roller sock to contact the wall surface. Since the teeth 192 of toothed roller 190 are extremely effective at engaging the painted wall surface 80, they may greatly facilitate the rolling of roller 30 or 130 and thus the efficient application of paint, when used on a slick, low friction wall surface. In the preferred embodiment, the toothed roller 190 would be constructed of a plastic material. However, many other types of material, such as metal, wood or the like, would be equally suitable.

Roller socks such as 30 or 130 are conventionally approximately four inches long and one inch in diameter. However, the present roller edge guard 20 apparatus is not limited to rollers of any particular size. Rather, it may be used with any type of conventional roller for preventing the unwanted deposit of paint in a corner or adjacent wall surface. It is even contemplated that special roller sock designs or squeegees could be used, depending on the type of wall surface or the design of the inside corner being painted.

In the preferred embodiment, the edge guard 20 and roller support arms 70/170 and 40/140, respectively, would be constructed of a zinc-coated rod or other similar material such as stainless steel. Clearly, the type of material used to construct these support members is not critical, rather only that they have sufficient strength and rigidity to support the roller and edge guard. Additionally, in the preferred embodiment, the handles 50 and 150 would be constructed of wood material such as oak or of plastic or the like.

In the preferred embodiment, the outer end 34/134 of the roller 30/130 is adapted to nearly contact the front face 25/125 of edge guard 20/120. In the preferred embodiment, the positioning of the edge guard and roller is such that when they are placed in the working position, an approximate 1/32" gap exists between the front face 25/125 of the edge guard and the end 34/134 of the roller. In operation, this 1/32" gap is filled by the flexible nap of roller sock 30 such that paint is applied to the wall surface up to the front face 25 of edge guard 20.

As mentioned above, the rotatable attachment of edge guard 20 to support shaft 70 allows the angle of the handle 150 to be changed while still keeping the shield fully engaged with the corner 96 being painted.

In the preferred embodiment, biasing springs 52 and 54 secured to opposite sides of edge guard support arm 70 and operative to bias support arm 70 in a neutral position would have an approximately five pounds of force. The inventor has found that this amount of biasing force is optimum in urging support member 70 into the neutral position, thereby maintaining pressure on the painting surface while still allowing the apparatus to be used without having to exert too much force to maintain the edge guard in contact with the corner.

One additional benefit of the second of the two embodiments of the present invention is that the split handle allows the roller portion to be used separately. As mentioned above, the roller 130 is secured to handle portion **150*b*. Thus, if it is desired to use the roller without the edge guard 20, such as to paint portions of the wall other than in the extreme corners, the two handle halves 150*a* and 150*b* may simply be separated and the handle portion 150*b*, supporting the roller 130**, used separately.

It is obvious that numerous other modifications and variations of the present invention are possible in view of the above teachings. For example, as already mentioned above, the apparatus is not limited to rollers having a particular dimension. Rather, it may be utilized with any variety of roller sizes so long as the support members 70 and 40 are constructed so that the roller and edge guards maintain the proper physical relationship. Additionally, an extension arm may be used in conjunction with the handles 50 or 150 to allow painting at more extreme heights.

In another alternative embodiment, the pivotal attachment of the edge guard support arm 70 illustrated in FIG. 6, may be constructed using a housing 56 which is adapted to be secured to the upper portion of handle 50 and having a generally V-shaped notch cut into housing 56 as indicated in FIG. 6. The biasing springs 52 and 54 would then be secured to opposite sides of support arm 70 and opposite sides of the V-channel, as shown in FIG. 6. An attachment pin 72 establishes the pivotal connection of support arm 70, allowing it move side to side within the V-channel shown in the figure. The housing 56 would then be secured to the side of handle 50, as shown in the figure, by any one of several means such as gluing or by use of a threaded screw or the like. Clearly there are several other alternative means of securing the support arm 70 to the handle which would be equally acceptable. For example, as mentioned above, the V-shaped notch and associated biasing springs may be set directly into the handle with a simple cover plate such as 56 operating to provide access to the attachment as necessary.

Therefore it is to be understood that the above description is in no way intended to limit the scope of protection of the claims and is representative only of the several possible embodiments of the present invention.

Thus, there has been shown and described an invention which accomplishes at least all of the specified objectives.

We claim:

1. A paint roller edge guard apparatus for use with a generally cylindrical roller sock, to facilitate the painting of a wall surface adjacent a non-painted surface by preventing the application of paint to the non-painted surface from the roller sock, the apparatus comprising:

a handle;

an edge guard having four edges and front and back faces;

means for pivotally and rotatably supporting said edge guard on said handle;

means for rotatably supporting a roller sock on said handle such that said roller sock may be rotated between a painting position, wherein the roller sock longitudinal axis is perpendicular to and adjacent said edge guard front face, and a filling position wherein the roller sock longitudinal axis is parallel to said edge guard front face; and such that upon placement of said roller sock in said painting position, and upon positioning of said edge guard in contact with said adjacent non-painted surface, said roller sock may be placed in contact with a painted wall by application of pressure to said handle deflecting said edge guard rearward allowing the roller sock to contact said painted wall surface applying paint thereto while said corner is kept clean of said applied paint.

2. The paint roller edge guard apparatus of claim 1 further comprising a means for biasing said edge guard support means and said edge guard in a neutral position defined as the approximate center of said pivotal travel of said edge guard support means.

3. The paint roller edge guard apparatus of claim 2 wherein said biasing means comprises at least one spring.

4. The paint roller edge guard apparatus of claim 1 wherein the generally cylindrical roller sock comprises opposite first and second ends, said first end being positioned adjacent said edge guard front face when said roller is positioned in said painting position and said second end is operative to receive said roller sock support means, the apparatus further comprising a engagement means positioned in and frictionally engaged by said roller sock second end such said engagement means having a diameter substantially equivalent to said roller sock such that upon application of pressure to said sock against said wall said engagement means engages said wall surface and further such that upon movement of said roller against said wall surface, said engagement means rotates in response thereto causing the cooperative rotation of said sock frictionally engaged therewith.

5. The paint roller edge guard apparatus of claim 1 wherein at least two of said four edge guard edges further comprise a bevel.

6. The paint roller edge guard apparatus of claim 1 wherein said means for means for rotatably supporting said roller sock comprises a shaft connected thereto and further comprising a lever connected therewith such that upon movement of said lever, said roller sock is movable between said painting and filling positions.

7. An apparatus for painting and protecting a wall surface, comprising a generally cylindrical roller sock for painting a wall surface and having opposite first and second end;

a handle;

an edge guard having four edges and front and back faces;

means for pivotally and rotatably supporting said edge guard on said handle;

means for rotatably supporting said roller sock on said handle such that said roller may be rotated between a painting position, wherein the roller sock longitudinal axis is perpendicular to and adjacent said edge guard front face, and a filling position wherein the roller sock longitudinal axis is parallel to said edge guard front face; and such that upon placement of said roller sock in said painting position, and upon positioning of said edge guard in contact with said adjacent non-painted surface, said roller sock may be placed in contact with a painted wall by application of pressure to said handle deflecting said edge guard rearward allowing the roller sock to contact said painted wall surface applying paint thereto while said corner is kept clean of said applied paint.

8. The combination of claim 7 further comprising a means for biasing said edge guard support means and said edge guard in a neutral position defined as the approximate center of said pivotal travel of said edge guard support means.

9. The combination of claim 8 wherein said biasing means comprises at least one spring.

10. The combination of claim 7 wherein said roller sock first end being positioned adjacent said edge guard front face when said roller is positioned in said painting position and said second end is operative to receive said roller sock support means, the apparatus further comprising a engagement means positioned in and frictionally engaged by said roller sock second end such said engagement means having a diameter substantially equivalent to said roller sock such that upon application of pressure to said sock against said wall said engagement means engages said wall surface and further such that upon movement of said roller against said wall surface, said engagement means rotates in response thereto causing the cooperative rotation of said sock frictionally engaged therewith.

11. The combination of claim 7 wherein at least two of said four edge guard edges further comprise a bevel.

12. The combination of claim 7 wherein said means for rotatably supporting said roller sock comprises a shaft connected thereto and further comprising a lever connected therewith such that upon movement of said lever, said roller sock is movable between said painting and filling positions.

13. A paint roller edge guard apparatus for use with a generally cylindrical roller sock, facilitating the painting of a wall surface, adjacent a non-painted surface, by preventing the application of paint to the non-painted adjacent surface from the roller sock, the apparatus comprising:

a handle having first and second portions;

an edge guard having four edges and front and back faces;

means for rotatably supporting said edge guard on said handle first portion;

a generally cylindrical roller sock having a longitudinal axis;

means for supporting said roller sock on said handle second portion such that said roller may be moved between a painting position, wherein said first and second handle portions are in adjacent relation such that the roller sock longitudinal axis is perpendicular to and adjacent said edge guard front face, and a filling position wherein the roller sock is separated from said edge guard; and such that upon placement of said roller sock in said painting position, and upon positioning of said edge guard in contact with an adjacent non-painted surface, said roller sock may be placed in contact with a painted wall by application of pressure to said handle deflecting said edge guard rearward allowing the roller sock to contact said painted wall surface applying paint thereto while said corner is kept clean of said applied paint.

14. The paint roller edge guard apparatus of claim 13 further comprising means for adjacent positioning of said first and second handle portions.

15. The paint roller edge guard apparatus of claim 13 further comprising a means for biasing said edge guard support means and said edge guard in a neutral position defined as the approximate center of said pivotal travel of said edge guard support means.

16. The paint roller edge guard apparatus of claim 13 wherein the generally cylindrical roller sock comprises opposite first and second ends, said first end being positioned adjacent said edge guard front face when said roller is positioned in said painting position and said second end is operative to receive said roller sock support means, the apparatus further comprising a engagement means positioned in and frictionally engaged by said roller sock second end such said engagement means having a diameter substantially equivalent to said roller sock such that upon application of pressure to said sock against said wall said engagement means engages said wall surface and further such that upon movement of said roller against said wall surface, said engagement means rotates in response thereto causing the cooperative rotation of said sock frictionally engaged therewith.

17. The paint roller edge guard apparatus of claim 13 wherein at least two of said four edge guard edges further comprise a bevel.

* * * * *